United States Patent [19]

Cavill

[11] Patent Number: 5,077,086

[45] Date of Patent: Dec. 31, 1991

[54] METHOD FOR THE TOUCH UP OF SCRATCHED PAINTED METAL PRODUCTS

[76] Inventor: David Cavill, P.O. Box 553, Ozona, Fla. 34660

[21] Appl. No.: 556,225

[22] Filed: Jul. 20, 1990

[51] Int. Cl.[5] ..... B05D 3/12

[52] U.S. Cl. ..... 427/142; 427/273; 427/277; 427/336; 427/355

[58] Field of Search ..... 427/355, 140, 142, 273, 427/277, 336; 118/100; 401/129, 195, 126; 264/36

[56] References Cited

U.S. PATENT DOCUMENTS

| | | | |
|---|---|---|---|
| 3,652,314 | 3/1972 | Castner | 427/140 |
| 3,950,571 | 4/1976 | McBride et al. | 427/142 |
| 4,814,200 | 3/1989 | Propst | 427/142 |

*Primary Examiner*—Shrive Beck
*Assistant Examiner*—Terry J. Owens
*Attorney, Agent, or Firm*—Paul J. Sutton; Barry G. Magidoff

[57] ABSTRACT

A method for repairing damaged metal surfaces. A marred painted surface, for example, the painted sheet metal forming automobile or truck bodies, which has been damaged by scratching or chipping of the paint to expose metal, is touched up so as to renew the continuous painted appearance and to prevent corrosion of the exposed metal by applying touch-up paint to the marred metal surface, and rubbing the touched-up surface and the immediately surrounding unmarred finished surface with a soft, flexible sheet material which has been wetted with a touch-up paint solvent composition, to remove the excess paint inadvertently spread over the old finish surrounding the scratch or chip. The flexible sheet material with the solvent is rubbed over the touched-up area only after the touch-up paint has partially set, generally from about 1 to about 15 minutes after application. The solvent composition comprises a paraffinic liquid solvent, and preferably also a stronger, more active solvent selected from the group of lower alkyl-substituted benzene and oxygenated aliphatic and cycloaliphatic hydrocarbon compounds and halogen substituted such compounds.

8 Claims, No Drawings

METHOD FOR THE TOUCH UP OF SCRATCHED PAINTED METAL PRODUCTS

This invention relates to a method and composition for repairing damaged painted metal surfaces. More particularly, the invention relates to a method and composition for touching up painted metal, such as for example automobile bodies formed from sheet metal, wherein the painted, enameled or lacquered finish has been inadvertently removed, as by a scratch or a chip.

It is a common practice, when the painted surface of, e.g., painted sheet metal automobile and truck bodies, are damaged by the scratching or chipping of the paint to expose the metal, to touch up the surface so as to renew the continuous painted appearance, and to prevent corrosion of the exposed metal. Generally, even a minor scratch or chip is considered to be a highly visible blemish to the appearance of, especially, passenger automobiles. The industry has long responded by providing relatively small containers, e.g. two fluid ounces, of a paint or enamel or lacquer (hereinafter broadly referred to as "paint") having a cap generally including a fine brush, for applying the coating to the scratch or chip and thus repairing the appearance of the automobile body.

A problem often met with in applying the paint is the difficulty of applying the paint to the scratched or chipped portion without also overpainting the surrounding unmarred finish with excess paint. Generally, the overpainted portion no longer matches the remainder of the surface and thus continues to lack an unblemished appearance which is desirable for a complete repair of the original finish. Although, individuals may have attempted to wipe away the excess new paint with a dry cloth, the problem has always been to remove the excess paint without, on the one hand, marring the original finish in those areas immediately adjacent the scratch or chip and, on the other hand, removing all of the paint applied to the chipped or scratched portion. Up to the present time there has been a notable lack of success in achieving a truly effective touch-up method which can be easily used by the general public.

It is an object of the present invention to provide a composition suitable for removing excess paint surrounding a repaired scratch or chip on a painted metal surface without either marring the old finish or removing the new coating.

It is a further object of this invention to provide a method for repairing scratches or chips on a painted metal automobile body surface so as to remove any excess new coating from above the original finish without either marring the original finish or removing the new paint from the chip or scratch.

It is yet another object of the present invention to provide a method, and a kit for carrying out the method and including a solvent composition, wherein excess touch-up paint applied to a blemished area of an automobile body surface, from which any excess new paint is removed from the immediately adjacent old finish surface, without either marring the old finished surface or removing the new paint from the exposed metal substrate.

In the method of this invention, after the touch-up paint is applied to scratched or chipped painted metal, the surface is rubbed with a soft flexible sheet material, which has been wetted with a touch-up solvent composition, to remove the excess paint inadvertently spread over the old finish surrounding the scratch or chip. The touch-up solvent composition can be any suitable paint solvent, including, e.g., mineral spirits, or other paraffinic liquid solvent. Preferably, however, the touch-up solvent composition comprises from about 1% to about 35% by wt. of an additional active solvent added to the above-described suitable paint solvent, which is wholly miscible with the paraffinic solvent in the proportions set forth. Preferably, there is present at least about 2% by wt. and most preferably at least about 5% by wt. of the active solvent. Further in accordance with this invention, the active solvent is a liquid which in substantially pure form is too strong of a solvent to be readily used without marring the original surface finish appearance.

The suitable paint solvents include, preferably, paraffinic solvents having a boiling point above about 200° centigrade, such as heptane, the ISOPARS, including ISOPAR C, ISOPAR E, ISOPAR G, ISOPAR H and ISOPAR K, as well as various mineral spirits having a boiling point in the range of between about 200° and about 400° centigrade. The above paint solvent can be used as a touch-up solvent composition alone, or as a diluent with the afore-described active solvents.

For ease of use, the solvent composition is preferably provided in a kit form; A preferred kit comprises a container of the touch-up solvent composition suitable as a dispenser, and a soft flexible sheet, buffing aid, such as a piece of woven or non-woven fabric, which can absorb the solvent composition from the container and buff the painted surface. Alternatively, a buffing aid comprising a soft surface on an otherwise rigid substrate can also be used.

The active solvent comprises lower alkyl- substituted benzene, such as toluene, xylene, ethyl benzene, methylethyl benzene and propyl benzene; oxygenated aliphatic and cycloaliphatic hydrocarbon compounds, including carbonyl-containing aliphatic and cycloaliphatic compounds, such as methylethyl ketone, acetone, methylisobutylketone, diacetone alcohol, and other alkyl ketones and esters, preferably having up to about eight (8) carbon atoms; lower aliphatic esters, such as ethyl acetate, butyl acetate, propylacetate, ethyl proprionate, and preferably having up to about eight (8) carbon atoms; and the hydroxylated ethers, such as the various CELLOSOLVE compounds, i.e., mono-and di-alkly ethers of ethylene glycol having up to about 14 carbon atoms, the aromatic-substituted such ethers, such as phenyl cellosolve, and the esters of such compounds, such as methylcellosolve acetate, n-hexyl cellosolve acetate, dibutyl cellosolve propionate and methylcellosolve acetate; and chlorinated benzenes and chlorinated aliphatic and cycloaliphatic hydrocarbons, such as 1,1,1-trichloroethane, and o-dichlorobenzene and dichlorotoluene.

For reasons of safety, it is preferred that the least volatile materials be used; these are customarily referred to in the trade as "odorless" solvents It is of course also necessary that the solvents be liquid at room temperature.

It is preferred that the touch-up paint be permitted to at least partially set, i.e., bond to the metal substrate, before rubbing with the touch-up solvent. This further improves the final appearance of the touched-up surface, and avoids interfering with the bonding of the touch-up paint to the metal, without reducing the effectiveness of the touch-up solvent in removing the excess paint applied over the original surface. It is recognized that the amount of time needed to partially set the touch-up paint varies depending upon the particular paint composition, and also possibly the precise nature of the metal substrate; it has been found that for the touch-up paints generally recommended by most contemporary automobile manufacturers, the touch-up paint should be permitted to rest for between about 1 and about 15 minutes, and preferably at least about three (3) minutes, before rubbing with the wetted buffing material, e.g., wetted soft cloth.

Embodiments of this invention which are presently preferred are set forth by way of example only in the following Working Examples. In the Working Examples, those materials which are commonly available to the ordinary consumer in the United States market are referred to by their common or generic name, where known, as well as by the trade marks under which they are sold at retail.

EXAMPLE 1

The right fender panel of a 1988 Chevrolet Station Wagon, formed of sheet steel, has a scratch of removed paint (approximately ⅛th of an inch in width and 2 inches long), extending at least partially down to the bare metal, so that the top layer of paint has been removed. Touch-up paint matching the color of the automobile is applied, utilizing paint from a bottle of touch-up paint recommended by the automobile company; the bottle has a brush extending from the interior of the cap. The paint is allowed to dry for five (5) minutes.

Although the touch-up paint was applied with great care, it was practically impossible not to leave a thin smear of the touch-up paint over the original finish immediately surrounding the chipped area. A touch-up solvent composition, formed by dissolving ten (10) parts by weight of toluene into ninety (90) parts by weight of painters' naphtha, sold as ISOPAR C, was used to thoroughly wet a soft cloth. The cloth is then used to gently rub over the touched-up, chipped area and the surrounding portions of the original paint finish, to remove all excess paint outside of the chip area. This was accomplished without removing the paint from the exposed metal surface.

The paint in the chipped area should then be left to dry for at least two (2) hours before buffing and waxing or otherwise polishing the surface. The repaired chipped area was almost indistinguishable from the surrounding original finish, and there was substantially no extra paint over the original finish in the area surrounding the touched up chipped portion.

EXAMPLE 2

The procedure in accordance with Example 1, above, was repeated but utilizing as the touch-up liquid composition painters' naphtha, as purchased. It was found to be necessary to rub with greater force, and that greater care needed to be taken to avoid removing paint from the scratched area and to avoid marring the original surrounding finish.

EXAMPLES 3-10

The procedure in accordance with Example 1, above was repeated but utilizing the touch-up liquid compositions shown in Table I, below.

TABLE I

| | Active Solvent | | Solvent | |
|---|---|---|---|---|
| Ex. No. | Compound | Parts by Wt. | Material | Parts by Wt. |
| 3 | Xylene | 15 | Heptane | 85 |
| 4 | Methyl Ethyl Ketone | 10 | #140 Solvent | 90 |
| 5 | Diacetone alcohol | 20 | ISOPAR G | 80 |
| 6 | Butyl CELLOSOLVE | 12 | IOSPAR H | 88 |
| 7 | Ethyl Acetate | 25 | ISOPAR K | 75 |
| 8 | 1,1,1-trichloroethane | 15 | ISOPAR E | 85 |
| 9 | dichlorotoluene | 15 | ISOPAR C | 85 |

In each case, substantially the same results were obtained as in Example 1.

I claim:

1. A method for touching-up a marred, painted metal surface from which a chip of paint is missing, marring the appearance of the painted surface, the method comprising applying touch-up paint to the marred surface, permitting the paint to rest upon the surface for a time sufficient to permit the paint to partially set, gently rubbing a soft flexible sheet material, wetted with a liquid touch-up paint solvent composition, over the touched up painted surface and the immediately adjoining unmarred areas while the touch-up paint is partially set, to remove any touch-up paint applied over the painted unmarred areas, and then permitting the touch-up paint to completely dry, the touch-up solvent composition comprising a paraffinic solvent.

2. The method of claim 1, wherein the touch-up solvent composition comprises 1 to about 35 percent by weight of an active solvent, and a miscible diluent for the active solvent.

3. The method of claim 2, wherein the active solvent is selected from solvent compound of the group consisting of lower alkyl-substituted benzenes, oxygenated aliphatic and cycloaliphatic hydrocarbon compound, and halogen atom-substituted such solvent compounds.

4. The method of claim 3, wherein the oxygenated aliphatic and cycloaliphatic hydrocarbon compounds are substituted with groups selected from the group consisting of ketonic carbonyl groups, esterified carboxyl groups, oxy-ether groups, and hydroxyl alcohol groups.

5. The method of claim 3, wherein the halogen atoms are chlorine atoms.

6. The method of claim 1, wherein the boiling point of the touch-up solvent is at least about 100° C.

7. The method of claim 1, wherein the paint is permitted to rest upon the surface for at least about 3 minutes.

8. The method of claim 1, wherein the paint is permitted to rest upon the surface for between about 1 and about 15 minutes.

* * * * *